US006325370B1

(12) United States Patent
Crotti et al.

(10) Patent No.: US 6,325,370 B1
(45) Date of Patent: Dec. 4, 2001

(54) AUTOMATIC BANKNOTE SELECTION AND DELIVERY SAFE

(75) Inventors: Alberto Crotti; Giancarlo Vincenzi, both of Poggio Rusco (IT)

(73) Assignee: CIMA S.p.A. di Razzaboni & Co. (IT)

( * ) Notice: Subject to any disclaimer, the term of this patent is extended or adjusted under 35 U.S.C. 154(b) by 0 days.

(21) Appl. No.: 09/487,667

(22) Filed: Jan. 19, 2000

(30) Foreign Application Priority Data

Jan. 21, 1999 (IT) ..... MO99A0003

(51) Int. Cl.[7] ..... B65H 31/00

(52) U.S. Cl. ..... 271/207; 902/8; 902/12; 902/16

(58) Field of Search ..... 902/8, 9, 12, 13, 902/16, 17; 271/207

(56) References Cited

U.S. PATENT DOCUMENTS 3,767,080 * 10/1973 Erickson .
4,529,119 * 7/1985 Granzow et al. ..... 902/8
4,540,106 * 9/1985 Fukatsu .
4,681,229 * 7/1987 Uesaka et al. .
4,697,071 * 9/1987 Hiraoka et al. ..... 271/291 X
4,972,958 * 11/1990 Ito et al. ..... 902/12 X
5,468,941 * 11/1995 Sasaki ..... 902/12 X
5,522,511 * 6/1996 Sakoguchi et al. ..... 902/12 X
6,098,837 * 8/2000 Izawa et al. ..... 902/13 X
6,206,284 * 3/2001 Do et al. ..... 902/8 X

* cited by examiner

*Primary Examiner*—Christopher P. Ellis
*Assistant Examiner*—Richard Ridley
(74) *Attorney, Agent, or Firm*—Shlesinger, Fitzsimmons & Shlesinger

(57) ABSTRACT

The automatic banknote selection and delivery safe consists of an armored boxed frame in one upper zone of which is mounted a first banknote acceptance device from which departs a first banknote grasping and conveyance means paths towards a first screening station thereof with associated detection means followed by a second station for sight sensing of the banknotes collected and alternate sending to a restitution door or to a third station of withdrawal from said first path and routing towards an underlying second path of sorting in a containment storage unit divided in preselectable modular tanks with there being provided inspection means for the correct positioning of the banknotes, removable cartridge means for accumulation of banknotes and at least one door directly opening on the exterior equipped with the usual electronic selection means for access to the automatic banknote delivery.

27 Claims, 7 Drawing Sheets

AUTOMATIC BANKNOTE SELECTION AND DELIVERY SAFE

BACKGROUND OF THE INVENTION

The present invention relates to an automatic banknote selection and delivery safe.

In banks the requirement to solve if not in a final at least in an acceptable manner the problem of safety which develops because of the daily handling of high quantities of money in the form of banknotes is still pressing.

At present there are installed various devices and barriers which select at the entrance the patrons and customers by having them pass through barriers detecting metals and similar materials with which arms could be constructed and which could be hidden under the clothing.

Even the various individual cash desks are equipped with safety devices designed to prevent robbery or to start operating upon the slightest threat thereof.

Despite these contrivances, although of a rather sophisticated nature, it still happens with considerable frequency that robbers and the ill-intentioned take aim at banks for their illegal actions, even using hostages found on site at the moment and carrying out the robbery while threatening the safety thereof.

In addition to this problem which is already significant in itself, there is a second related to the professional activity of the cashiers who are daily forced to carry out repeated and extenuating counts substantially by hand of a large number of banknotes for each withdrawal or deposit to be made.

This repetitiveness negatively influences the level of attention and concentration of those assigned who might, because of this, make counting errors, creating troublesome conflict situations, especially with the customer and to solve which it is often necessary to have recourse to mediated settlements which, in fact, satisfy neither the bank nor even less the customer who retains the doubt that he has been tricked due to an error to say the least not made personally.

At this time there are produced and used some safes which permit automatic collection or delivery of the banknotes at each accounting operation to be carried out. But the entire operational cycle takes place within a closed and of course armored casing whose operational members are controlled and commanded by a cashier of the bank by means of a computer.

While representing considerable progress whether for the safety solution, such known safes being not removable from their place of installation, or in aid to the manual nature of the cash operations, there remains still totally unresolved the problem concerning the component of distrust by the customers for whom it is absolutely impossible to verify agreement of the amount deposited and the amount actually collected by the machine. Just think for example of an accidental overlapping of banknotes which are received as though they were only one while in reality they are two or more.

Any protest and complaint by the customer cannot find direct corroboration and therefore satisfaction by the cashier who performs the operation because not even in this case is it possible to verify, at least in real time, whether the complained of error occurred or not.

Lastly, known safes cannot offer a banknote distribution function directly to customers without the personal intervention of the cashier.

Lastly, the supplying of banknotes in known safes takes place with the intervention of a trusted employee, in general a member of a security service who must materially open the safes to gain access to the internal storage space. This is normally made up of a series of parallel boxes in which are accumulated the banknotes divided by denomination and which are withdrawn and replaced in both resupply and withdrawal operations.

In conclusion the employee can always accede directly to the money with all the risks which this implies.

In addition to this the above mentioned replacement operation, considerably costly for the bank, takes place sometimes even if the above mentioned tanks are not completely empty, increasing overhead costs.

Another problem with known safes is that if the electronic apparatus which controls their operation detects some anomalies during performance of the monetary operations, e.g. accidental overlapping of banknotes, the operations are canceled totally, requiring for the performance thereof complete repetition of all the procedural steps and causing a considerable loss of operational time and the need to have available a larger quantity of banknotes.

The general purpose of the present invention is to remedy the above mentioned shortcomings of the prior art by making available an automatic banknote selection and delivery safe permitting verification in real time of the agreement of each accounting operation with the number and denomination of banknotes handled for each operation to avoid the risk of unpleasant differences between customers and cashiers and possibly canceling the doubtful operation and restoring the collected banknotes.

Another purpose of the present invention is to make available an automatic banknote selection and delivery safe of the greatest safety while allowing with each withdrawal or supply operation by employees without providing direct access to the interior thereof.

Another purpose of the present invention is to make available an automatic banknote selection and delivery safe permitting distribution of sums of money without requiring the direct presence of an assigned operator, possibly with the employment of usual electronic access code recognition means.

SUMMARY OF THE INVENTION

This and other purposes are achieved by an automatic banknote selection and delivery safe characterized in that it consists of an armored boxed frame in one upper zone of which is mounted a first banknote acceptance device from which departs a first banknote grasping and conveyance means path towards a first screening station thereof with associated detection means followed by a second station for sight sensing of the banknotes collected and alternate sending to a restitution door or to a third withdrawal station from said first path and routing towards an underlying second path of sorting in a containment storage unit divided in preselectable modular tanks with there being provided inspection means for the correct positioning of the banknotes, removable cartridge means for accumulation of banknotes and at least one door directly opening on the exterior equipped with the usual electronic selection means for access to automatic banknote delivery.

BRIEF DESCRIPTION OF THE DRAWINGS

To clarify the explanation of the innovative principles of the present invention and its advantages compared with the prior art there is described below with the aid of the annexed drawings a possible embodiment thereof by way of non-limiting example applying said principles. In the drawings.

DETAILED DESCRIPTION OF THE INVENTION

Figure 1:
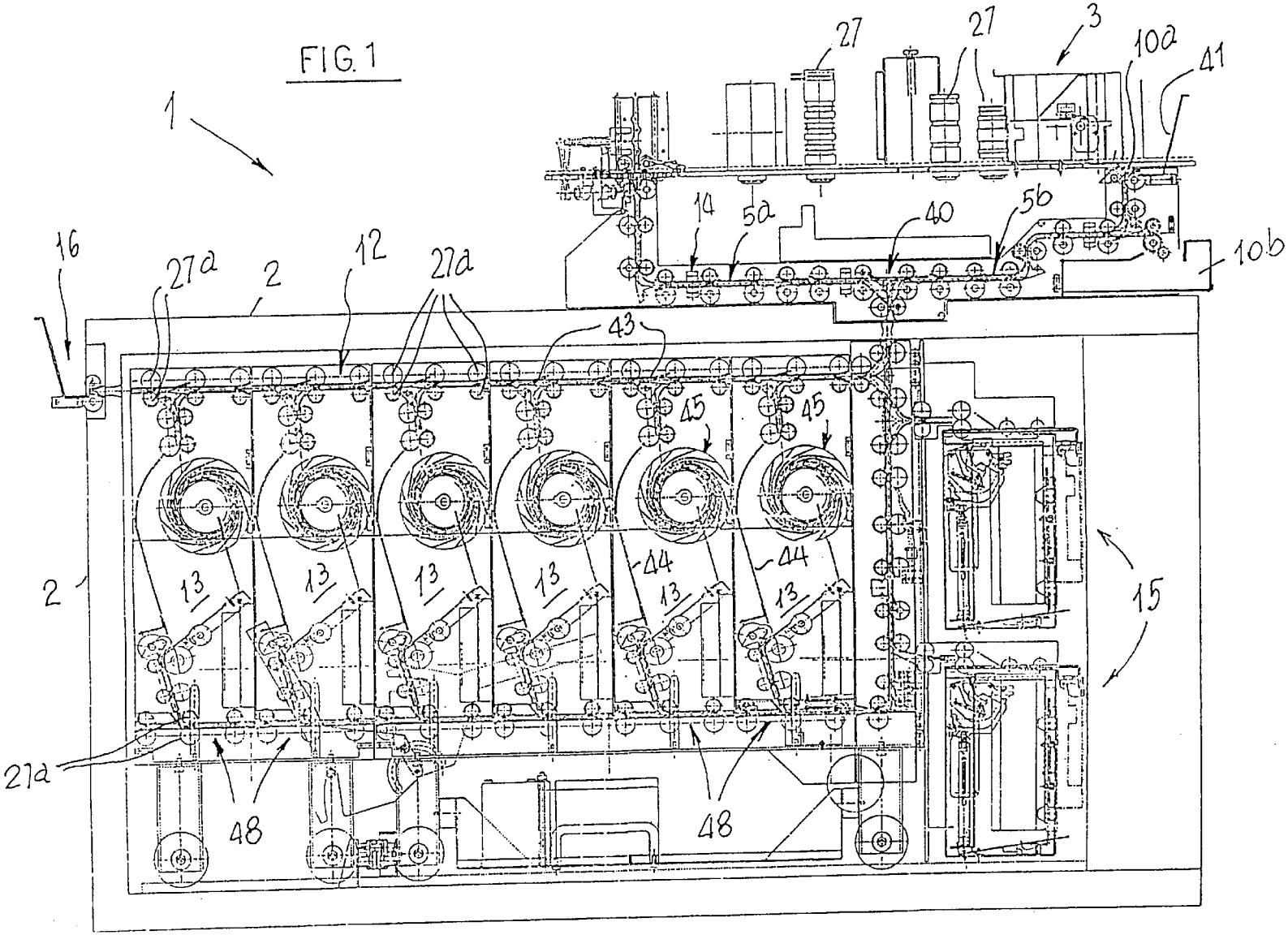
FIG. 1 shows from the side a section plane of the safe in accordance with the present invention.
Figure 2:
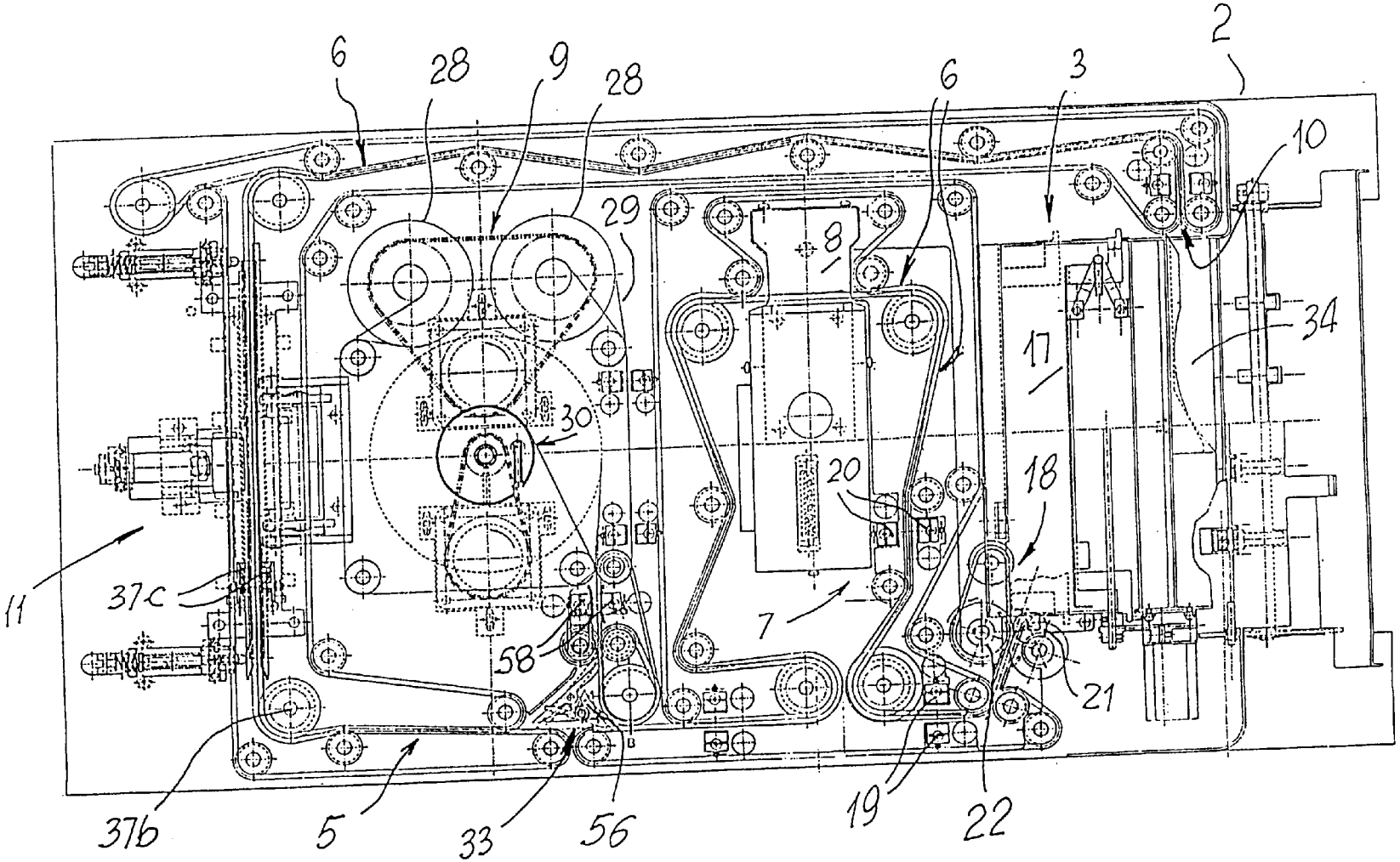
FIG. 2 shows in slightly larger scale a section plane of the upper zone of the safe.
Figure 3:
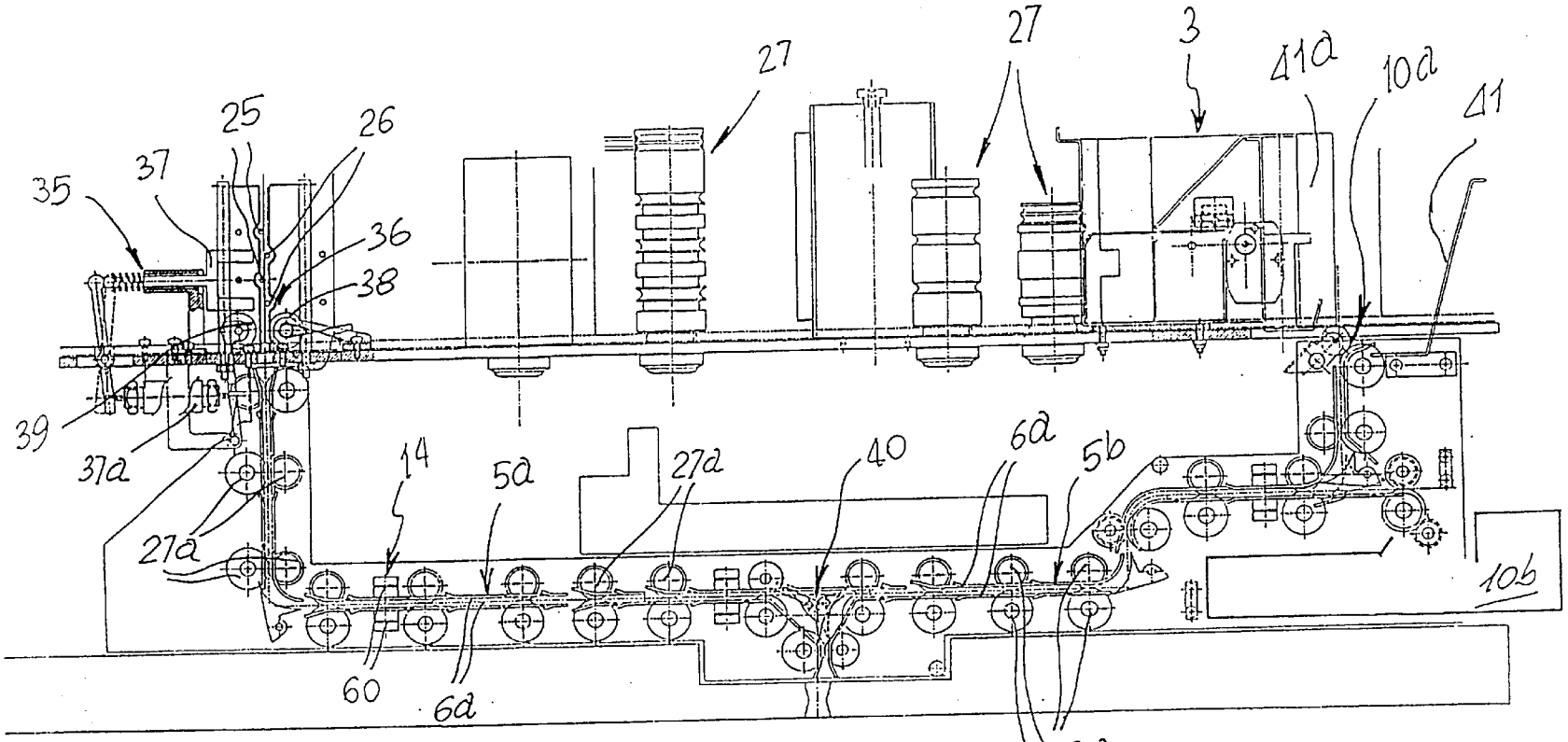
FIG. 3 shows the view of FIG. 2 from the side.
Figure 4:
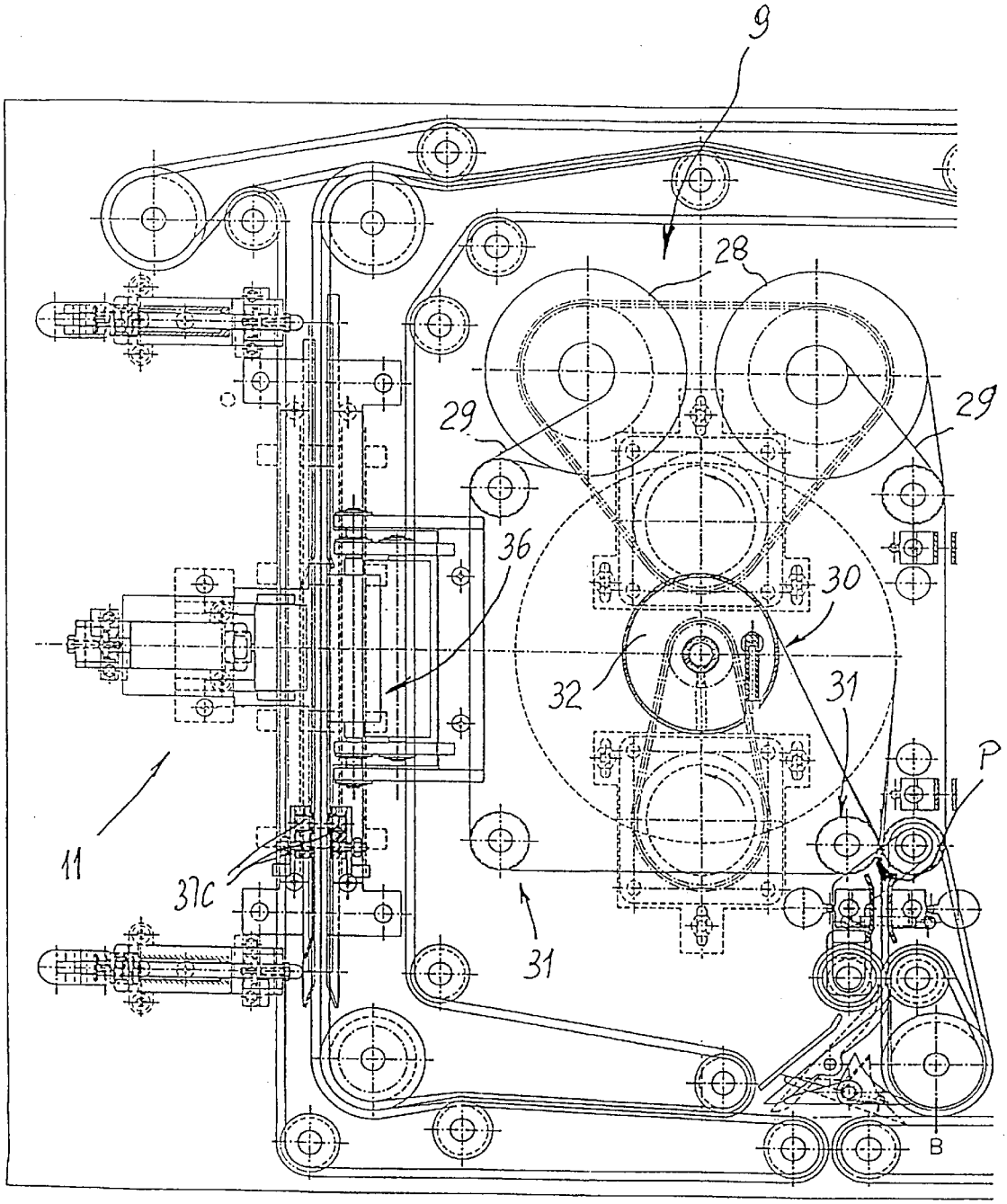
FIG. 4 shows from above in enlarged detail a second station for sight sensing of the banknotes collected and a third station for withdrawal and routing of the banknotes from a first path to a second path underlying.
Figure 5:
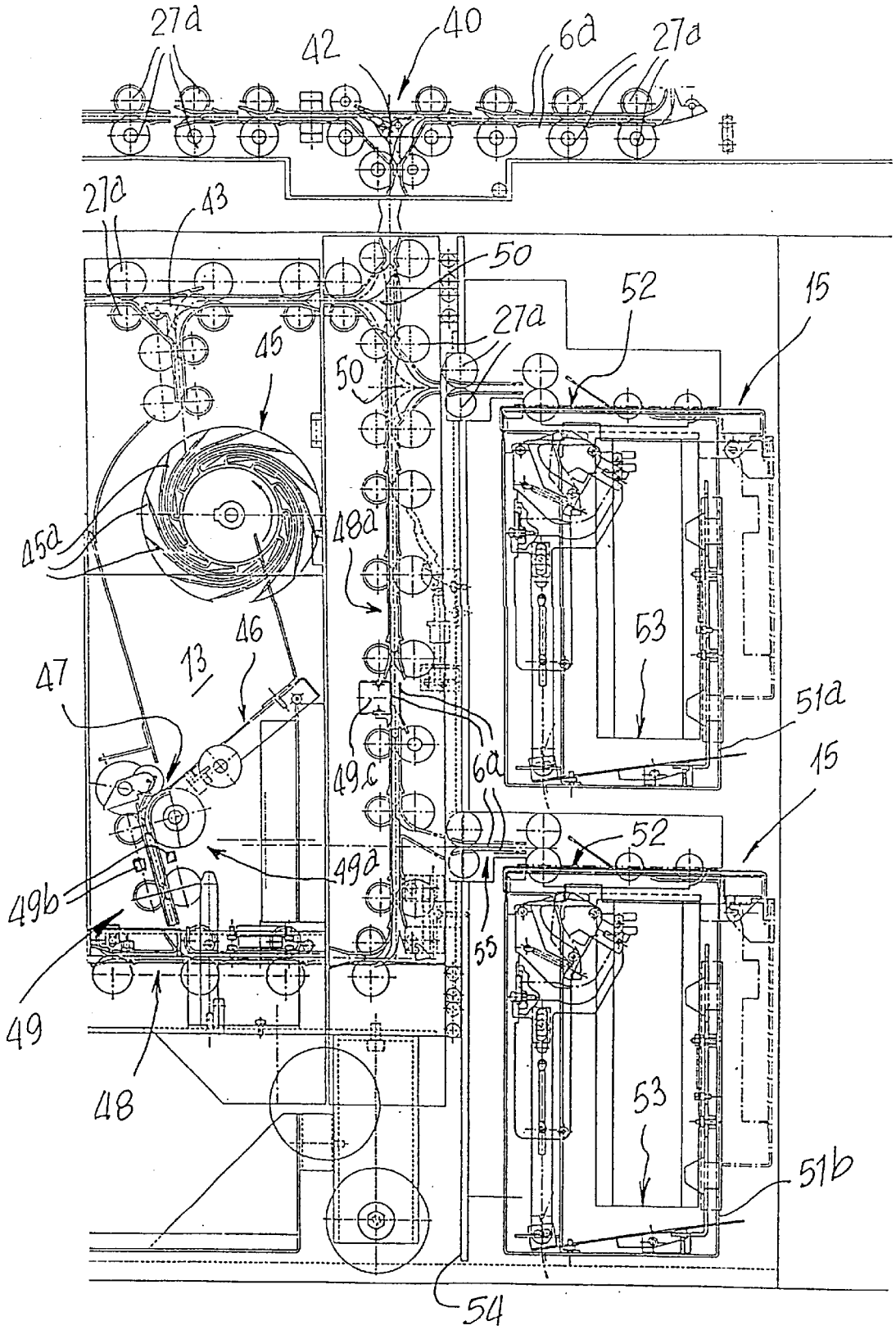
FIG. 5 shows a side view in enlarged detail of a portion of a storage container and a contiguous zone for positioning of removable cartridge means for accumulation of banknotes.
Figure 6:
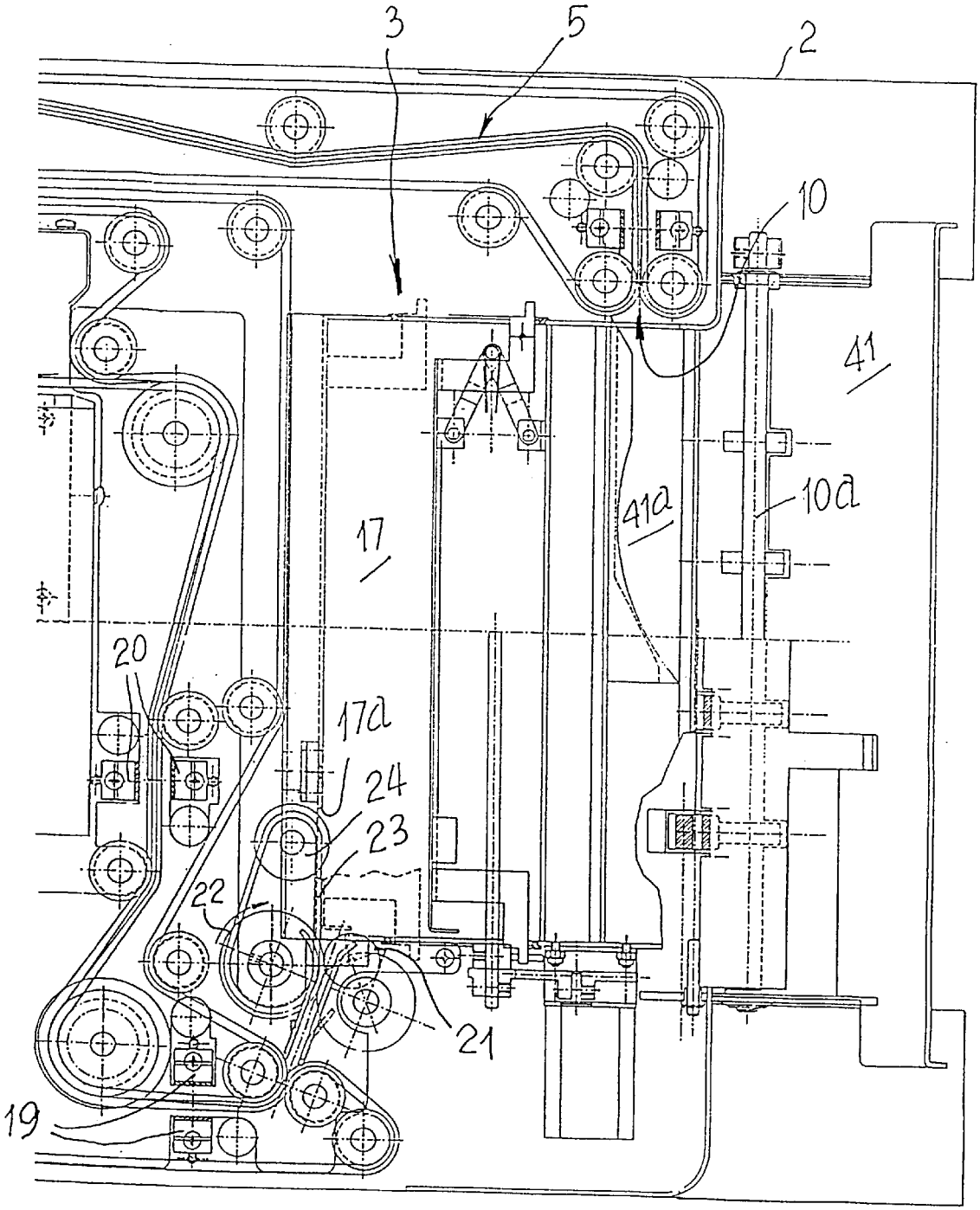
FIG. 6 shows a top view in enlarged detail of a first banknote acceptance device.
Figure 7:
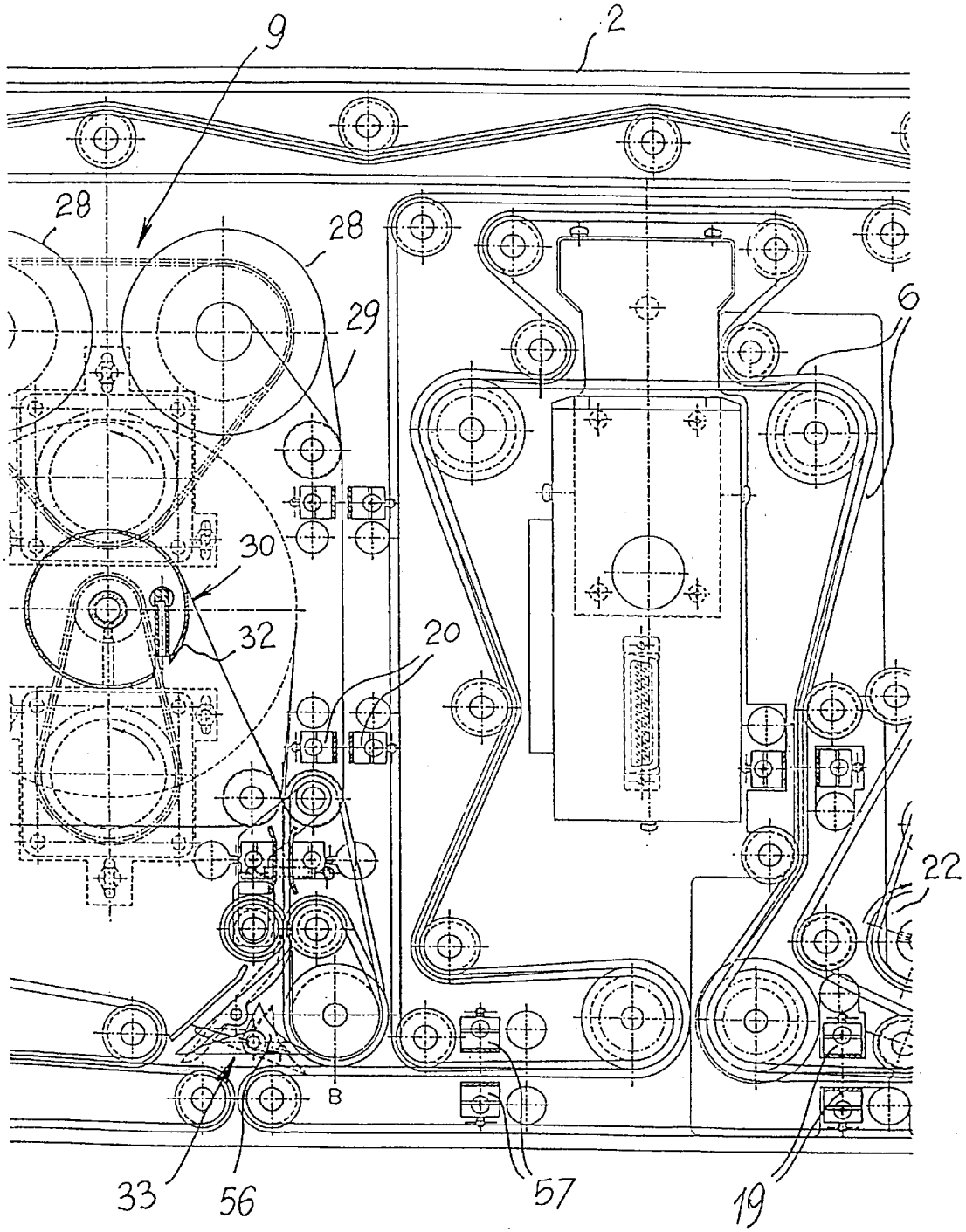
FIG. 7 shows an enlarged side view of a detail of the first and second stations.

With particular reference to the FIGS reference number 1 indicates an automatic banknote selection and delivery safe consisting of an armored boxed frame 2 in an upper zone of which is installed a first banknote acceptance device 3 from which departs a first path 5 for means 6 of grasping and conveying banknotes to a first station 7 for screening thereof by associated sensing means 8.

The first station 7 is followed on the path 5 by a second station 9 for sight sensing of the collected banknotes. From this second station 9 the banknotes, excepting anomalies as discussed below, are sent to a third station 11 for withdrawal from said first path 5 and routing towards an underlying second path 12 for sorting towards a storage container divided in a series of preselectable modular tanks 13.

One of the above mentioned anomalies might be where some banknotes are recognized in station 7 as false or even only too worn and are sent directly to door 10 bypassing the second station 9 and therefrom gathered in a tank 41*a*.

Along the first path 5 are also provided means 14 for control of the correct positioning of the banknotes and at the modular tanks 13 removable cartridge means 15 with the duty of accumulation of the banknotes. In the higher portion of the safe 1 is also provided a door 16 directly opening on the outside equipped with usual electronic selection means for access to the automatic banknote delivery.

The banknote acceptance device 3 comprises a vertical tank 17 with open top and connected with an inlet slot in the upper face of the boxed frame 2 and not visible in the drawings. In the tank 17 the banknotes are arranged on edge and it is equipped on one side with a window 17*a* opposite to a means 18 with alternating intervention for the individual and repeated grasping of the lead sides of the banknotes contained in the tank 17 and for insertion thereof in the first path 5 with predetermined cadence piloted by first sensor means 19 positioned immediately downstream of the individual grasping means 18.

Downstream of the first sensor means 19 are provided second sensor means 20 designed to detect together with 19 the correct spacing of the banknotes. Both of these means 19 and 20 consist of conventional photodetectors positioned bilaterally with the path 5.

The individual grasping means 18 consist essentially of a pair of rollers 21 and 22 with vertical axis and made of high adherence material. The rollers 21 and 22 are arranged side-by-side and a first roller 22 which is the driver is fixed axially while the second 21 is mounted to be movable laterally from a position separated from the first roller 22 to a position of contact with it. On the first roller 22 is wound a ribbon 23 closed in a loop on a third roller 24 which is driven. The active branch of the ribbon 23 is arranged parallel and contiguous with the window 17*a* for adherent contact with the banknotes and extraction thereof from the vertical tank 17.

The grasping and conveyance means 6 consist, at least for the first path 5, of pairs of powered tracks 25 and 26 which are arranged superimposed and mutually facing at different heights so as to be offset. Between these pairs of tracks 25 and 26 can be inserted the banknotes and the above mentioned tracks are closed in a loop on corresponding pluralities of rollers 27 both driving and driven which define the first and second paths.

The second sight sensing station 9 comprises delivery means, i.e. in practice a pair of spools 28, of facing segments of transparent film 29 between which can be inserted the banknotes and drum means 30 on which can be wound said segments 29 incorporating the banknotes.

Downstream of the spools 28 are provided usual members for tensioning and transmission 31 towards point P of insertion of the banknotes between them.

The drum means 30 consist of a cylinder 32 with vertical axis supported on the boxed frame 2 and which rotates, being motorized. On the surface of the cylinder 32 can be wound in layers or unwound therefrom the segments of film 29 incorporating the banknotes. The diameter of the cylinder 32 is preset to support the complete winding of the banknotes collected with each deposit performed by a cashier.

The cylinder 32 is supported on the frame opposite a windowed wall in the boxed frame 2 not visible in the drawings which are transparent and designed to allow direct inspection of the banknotes wound on the above mentioned cylinder 32.

Upstream of the second station 9 is provided on the path 5 of the grasping and conveyance means 6 a directional switch member 33 for sending the banknotes towards the cylinder 32 or towards a return branch of the first path 5 directly confluent in the banknote restitution door 10 and therefrom into a seat 34 contiguous with the tank 17.

The third station 11 for banknote withdrawal from the first path 5 and routing thereof towards the second path 12 comprises a local spacer member 35 of the track pairs 25, 26 for release of the banknotes and a corresponding underlying member 36 with rollers for grasping the released banknotes.

The local spacer member 35 consists of a pair of forked hammers 37 arranged across said path 5 and mutually parallel with spacing greater than the greatest dimension of a banknote. The hammers are movable alternately and operated by an electromechanical actuator 37*a* from an active contact and removal position with the distal pair of tracks 26 in a retracted nonintervention position.

Operation of the forked hammer 37 is piloted by a pedometer means 37*b*, in this case an encoder which is positioned upstream of the station 11 and is enabled at each banknote counting cycle by a sensor means 37*c* of the front edge of each individual banknote.

In greater detail, the roller member 36 for grasping the released banknotes consists of a pair of facing rollers 38 and 39 with axes parallel to the corresponding branch of the path. Vertically beneath the latter are joined by contact the mutual external surfaces of the rollers 38, 39 at least one of which is fixed while the opposing one is rotating, motorized and movable from a contact and grasping position for the lower edge of each banknote and a diverging one to facilitate falling of the banknotes between them.

Immediately downstream of the banknote withdrawal and routing third station 11 is provided a section of the path 5*a* for control of the correct positioning of the banknotes, a section which flows into a bifurcation 40 with two alternative directions possible, a first one towards the underlying second path 12 and a second one towards a return branch 5*b* in turn divided in two directions, a first one which is directed to a purposeful tank 41 arranged contiguous with the banknote acceptance device 3 and a second one to a scrap storage container 10*b*.

In detail, both the sections 5*a* and 5*b* and the underlying second 12 and third 48 paths together with the appendage 48*a* consist of a track made up of parallel guides all indicated by reference number 6*a* in the drawings and between which run the banknotes and into which creep pairs of entrainment wheels, also indicated by reference number 27*a,* until they make contact with the latter through openings provided.

The bifurcation 40 is served by a conventional switch 42 controlled by a pair of sensors 61. Another pair of sensors 60 has the function of sensing the angular position of the banknotes coming from the station 11 and selecting those not correctly positioned in accordance with the translation axis and sending them directly to the above mentioned scrap storage container 10*b*.

The modular tanks 13 are fixed and located in sequence along the second path 12 with the respective entrance sides controlled by switch devices 43 quite like the previous one 42.

In addition each modular tank 13 consists in itself of a boxed body 44 in whose upper mouth is mounted a selector 45 with drum rotating by successive steps on a horizontal axis and having radiating notches 45*a* for insertion and counting of the banknotes. The selector 45 overlies a lower table 46 on which are collected and stacked the banknotes scrapped by the selector. The table 46 can be inclined as seen in the FIGS or have a chute for banknote issue which is in turn controlled by associated withdrawal means 47 and which deposits the banknotes on an underlying third path 48 for return thereof to the restitution door 10*a* to accumulate them in the tank 41.

The above mentioned withdrawal means 47 consist of a series of cascaded roller pairs 49 facing each other and at least the first of which 49*a* has alternative movement between a configuration for passage of the released banknotes and one of interception and stopping thereof.

Immediately downstream of each pair of rollers 49*a* is provided another pair of sensor means 49*b* which sense any overlapping of the banknotes withdrawn from the tanks 13. The third path 48 has downstream of the tanks 13 a set of switch devices indicated by reference number 50 and these also quite like the previous ones 42, 43 for sending the banknotes alternatively towards the cartridge means 15 or towards the door 16 directly opening on the exterior.

Along the third path 48 and exactly along a rising branch 48*a* thereof is placed another sensor 49*c* which has a dual function, to wit, recognizing both any overlapping and the type and denomination of the banknotes transiting on said branch 48*a* coming from one of the cartridge means 15. The above mentioned sensor 49*c* constitutes together with another sensor 60 placed downstream of the station 11 an example of activation of the inspection means of correct positioning of the banknotes.

The above mentioned cartridge means 15 consist of at least one pair of boxed containers 51 for the banknotes which are positioned one over the other and have respective controlled slots 52 for introduction of the banknotes or exit thereof.

These boxed containers 51 are also provided internally with means 53 for vertical conveyance thereof and on the outside with conventional means, not illustrated, of engagement with said armored boxed frame 2.

In practice they are located on an accessible side of the frame 2 but separated from the modular tanks 13 of the storage container by an associated bulkhead 54.

Between the boxed containers 51 and the second path 12 and the third 48 are placed corresponding connection lengths 55 made with the same grasping and conveyance means 6*a*.

In detail, of the boxed storage containers 51 the top one 51*a* is essentially assigned to receiving the banknotes coming from emptying of the modular tanks 13 while the bottom one 51*b* is for feeding resupply of banknotes to restore the stock in the tanks 13.

Operation of the banknote selection and delivery safe is fully automatic and managed by a computer usable e.g. by a cashier of a bank. Accordingly in the following description all the informatics members are ignored because normally known to one with average skill in the art.

When a cashier receives an amount of money in banknotes to be deposited he introduces the banknotes in packs on edge in the tank 17 through an associated slot made in the boxed frame 2 which covers the safe 1 coinciding with the opening thereof.

The banknotes which are the object of the deposit operation are first taken one by one by adherent contact with the ribbon 23 after intermittent operation of the drive roller 22 which lies in contact with the opposing one 21 and then inserted and held between the tracks of the pairs 25, 26 which constitute the grasping and conveyance means 6 of the first transfer path 5 which carry them to the following first screening station 7 for good or bad recognition and for appraisal of a possible excessive state of wear.

A first pair of sensors 19 located downstream of the pair of rollers 21, 22 senses the passage of the individual banknotes and the frequency thereof in such a way that it is held within the preset values in the electronic control logic and consequently also piloting the corresponding frequency of the repeated operations of the drive roller 22 and the withdrawal ribbon 23.

A second pair of sensors 20 measures upon their passage the distance between the consecutive banknotes and pilots cyclic operation above mentioned of the drive roller 22.

If a banknote is recognized by the sensing means 8 as false or excessively worn, when it is intercepted by the pair of sensors 57 located downstream the latter operate the shift 56 which goes into a configuration such as to direct the banknote or banknotes directly onto the return path 5 passing through the third station 11 until they reach the banknote restitution door 10 and completely bypassing the second station 9. The rejected banknotes are then deposited in the storage unit 41*a* into which flows the door 10.

On the contrary the good banknotes are diverted by the switch 56 towards the second sight sensing station 9. In detail each banknote is sensed by the pair of sensors 58 and inserted between the segments of transparent film 29 which unwind progressively step-by-step from the spool 28 and wound together with the others on the cylinder 32 which, being located in direct view of the user even though through a purposeful window with safety glass and made in the boxed frame 2, allows the user to visually observe the agreement of the number and type of banknote delivered to the cashier for the accounting operation.

The diameter of the cylinder 32 is such as to allow winding loaded with a large number of banknotes. Nevertheless if the number were such as to not be entirely loadable on the cylinder 32 in a single step the accounting operation would be divided in two or more consecutive periods.

If there is a protest during sight verification of the agreement between the banknotes deposited in the accounting operation and those collected by the safe 1 the latter are all expelled from the cylinder 32 and sent back directly to the tank 41 passing through the third station 11. On the contrary if the customer and the cashier have verified together the correctness of the data the cashier commands continuation of the operation by means of his computer.

The segments of film 29 are then unwound from the cylinder 32 and the banknotes extracted therefrom. The segments 29 again wind onto the respective spools 28.

The banknotes are sent at the third banknote withdrawal and routing station 11 towards the second path 12 underlying for sorting to the various modular tanks 13 in each of which are deposited banknotes of the same denomination.

In the third station 11 upon passage and sensing of each banknote performed by sensor means 37*c* which, with the intervention of the counting of the encoder 37*b*, guides its centered position and reads its longitudinal dimension and then the denomination to which it belongs, the pairs of forked hammers 37 intervene being spaced in such a manner as to be slightly outside the head and tail edges of each banknote. The hammers 37 push away, even if only in the zone involved, the pair of distal tracks 26 from the pair 25 to free the banknote from the clamping and let it fall between the underlying pair of rollers 38, 39 appropriately separated from each other.

As soon as the banknote is between these rollers they close and rotate to extract it from the path 5 to send it onto the section 5*a* along which is provided the other pair of sensors 60 which verify the perfect axial alignment of the banknote.

If the alignment does not match the requirements of the electronic control the switch 42 arranges itself so that the banknote will transit from the section 5*a* in the direction of section 5*b* and reach the scrap storage container 10*b* located quite near the tank 17. If alignment is satisfactory the switch 42 arranges itself so as to divert towards the underlying second path 12 the banknote which, depending on denomination, is conveyed to the corresponding tank 13 to which it was assigned at its previous moment of passage towards the sensing means 8 of the first station 7.

In practice each banknote moving in the safe 1 is always locatable by the control electronics since both the pairs of tracks 25, 26 constituting the grasping and conveyance means of the first path 5 and the pairs of entrainment wheels 27*a* are moved by motors having the usual precision counting means for the translation steps.

When a banknote is about to reach the mouth of the tank 13 to which it is assigned the associated switch 43 located upstream thereof arranges itself so as to divert the direction of the banknote towards the same upper mouth of the boxed body 44 opposite which is located the drum selector 45. The banknote inserts itself in one of the radial notches 45*a* and the selector rotates to unload it on the inclined plane 46 on which it is accumulated with others until they fill the modular tank or tanks 13.

If this happens and other banknotes assigned to the full tanks 13 are arriving, a predetermined number of banknotes are taken therefrom by withdrawal means 47 located underlying the table 46 and therefrom are input onto the third path 48 by which they reach the switch 50 which arranges itself so as to divert these excess banknotes inside at least one of the boxed storage containers 51, in this case the upper one.

Inside the latter the means 53 for vertical conveyance receive the banknotes by lowering progressively by one step for each of them.

If the cashier in a subsequent operation should make a money withdrawal, entering in the computer in addition to the total amount also the denomination of the banknotes which the customer desires, the banknotes of the required denomination are unloaded from the various modular tanks 13 in which they are accumulated again with the intervention of the withdrawal means 47 which deposit them in succession on the third path 48. Therefrom they are routed onto the rising section 48*a* and the switches 50 arrange themselves so as to direct these banknotes onto the second path 12 to reach the door 16 directly turned outwards and thence to the customer or towards section 5*b* and therefrom to reach the tank 41 from which they can be taken by the cashier and delivered to the customer.

In the step of withdrawing banknotes from the tanks 13 there is exerted by the sensors 49*b* an inspection operation. If there is a partial or total overlapping of banknotes the accounting operation is divided and not canceled as a whole.

The same thing takes place in the similar case of overlapping of banknotes coming only from the boxed container 51*b* and sensed by the sensor 49*c* located on the rising branch 48*a* of the third path 48.

In practice to the scrap storage container 10*b* are sent only the overlapped banknotes and simultaneously the total counting of the banknotes involved in the accounting operation is stopped for the time necessary for removal of the overlapped and located banknotes.

The accounting operation continues then with the withdrawal of additional banknotes for replacement up to completion of the total number of banknotes necessary for the entire accounting operation.

Briefly the ability to divide the accounting operations permits considerable reduction of the time for banknote withdrawal, reducing at the same time the number of banknotes sent to the scrap storage container 10*b*, thus lengthening the time for emptying it.

When the upper boxed storage container 51*a* for recovery fills its banknote containment capacity, a bank courier service employee can remove it and replace it with an empty one, all without having even visual access to the interior of the modular tanks 13 which are protected by the bulkhead 54.

If on the contrary one of the modular tanks 13 becomes empty, its usability can be restored by taking the missing banknotes from the other storage container 51*b* below. The bank courier service employee also resupplies full boxed containers 51*b* which automatically become accessible only when they are hooked to the boxed frame 2.

From the resupply container 51*b* the banknotes are pushed towards the slots 52 by the means 53, routed onto the rising branch 48*a* passing the screening of the sensor 49*c* which determines type and denomination. The switches 50 arrange themselves so as to divert the banknotes onto the second path 12 and therefrom to the interior of the tanks 13 either partially or totally unloaded already divided by denomination.

It is noted that the safe 1 is capable of sensing even any bad state of preservation of the banknotes by the sensing means 8 of the second station 7. In this eventuality the bedraggled banknotes follow the same path as the false ones.

It has been observed in practice that the present invention achieves the preset purposes. The present invention thus conceived is susceptible of numerous modifications and variants all falling within he scope of the inventive concept.

In addition all the details are replaceable by others technically equivalent.

In practice the materials used as well as the shapes and dimensions can be any whatever depending on requirements without thereby leaving the scope of protection of the following claims.

What is claimed is:

1. Automatic banknote selection and delivery safe comprising a first banknote acceptance device from which departs a first path having means for grasping and conveying banknotes towards a first screening station thereof with associated detection means, followed by a second collecting and resting station of the banknotes collected and contained in a chamber provided with a window for sight sensing of the banknotes and alternate sending to a restitution door or to a third withdrawal station from said first path and routing towards an underlying second path of sorting into a containment storage unit and at least one door directly opening to the exterior and equipped with electronic selection means for accessing the automatic banknote delivery.

2. Safe in accordance with claim 1 wherein said banknote acceptance device comprises a vertical tank with open top connected to an introduction slot in an upper face of a boxed frame, tank in which said banknotes are arranged on edge and which has on one side a window opposite an individual alternating grasping intervention means for the lead sides of said banknotes on edge for insertion in said first path at predetermined cadence piloted by first sensor means.

3. Safe in accordance with claim 2 wherein said first sensor means are positioned immediately downstream of said individual grasping means by pulsed activation of said individual grasping means.

4. Safe in accordance with claim 2 wherein downstream of said first sensor means are provided second sensor means for sensing the delivery step between the banknotes.

5. Safe in accordance with claim 3 wherein said individual grasping means consist of a pair of rollers with vertical axis and of high adherence material arranged side by side with a first roller being axially fixed and a driving second with intermittent intervention interlocked with said second sensor means for sensing steps located in contact with said first roller with there also being wound on said second roller a ribbon closed in a loop on a driven transmission third roller with the active branch parallel and contiguous with said window for adherent contact with the banknotes and extraction thereof from the vertical tank.

6. Safe in accordance with claim 1 wherein said grasping and conveyance means consist, at least for the first path, of track pairs wound on associated rollers and motorized by drive groups having precision step counting means, tracks which are arranged superimposed and in mutually facing pairs between which can be inserted the banknotes with said tracks being closed in loops on corresponding pluralities of drive and transmission rollers defining said first and second paths.

7. Safe in accordance with claim 6 wherein said superimposed track pairs are arranged vertically offset with each other.

8. Safe in accordance with claim 4 wherein said first and second sensor means consist of pairs of photosensors respectively for the cadence of the active intermittence of said second motorized roller and of the delivery step of the transiting banknote with each pair being arranged bilaterally to a section considered initial of said grasping and conveyance means path directed to said first screening station.

9. Safe in accordance with claim 1 wherein said second sight sensing station comprises delivery means for facing segments of transparent film between which can be inserted the banknotes and drum means for winding said segments incorporating the banknotes.

10. Safe in accordance with claim 9 wherein said delivery means consist of a pair of delivery spools for said segments downstream of which are provided usual members for tensioning and transmission towards the point of insertion of the banknotes between them.

11. Safe in accordance with claim 9 wherein said drum means consist of a cylinder with vertical axis supported on said boxed frame and motorized to rotate and on the surface of which segments of film incorporating the banknotes can be wound in layers or from which they can be unwound with the diameter of said cylinder being arranged for complete winding of the banknotes collected upon each deposit.

12. Safe in accordance with claim 11 wherein said cylinder is supported on said frame opposite a windowed wall of said boxed frame designed to allow direct inspection of the banknotes wound on said cylinder.

13. Safe in accordance with claim 1 wherein upstream of said second sight sensing station is provided on the path of said grasping and conveyance means a switch member for sending the banknotes to said cylinder or for return thereof on a branch for direct connection with said restitution door.

14. Safe in accordance with claim 6 wherein said third station for withdrawal from said first path and routing towards said second path comprises an optional local spacer member for the track pairs for release of the piloted banknotes by centered matching thereof and a corresponding underlying member with grasping rollers for the released banknotes.

15. Safe in accordance with claim 14 wherein said centered matching means consist of a step counting member housed upstream of said third station and interlocked with a means for sensing the presence of each banknote.

16. Safe in accordance with claim 14 wherein said local spacer member consists of a pair of forked hammers arranged across said path and mutually parallel with spacing greater than the greatest dimension of a banknote, movable and operated by an electromechanical actuator alternatively in contact for pushing away with the pair of distal tracks constituting said grasping and conveyance means.

17. Safe in accordance with claim 14 wherein said rollered grasping member for the released banknotes consists of a pair of facing rollers with axes parallel with the corresponding branch of said path underneath the vertical of which the mutual external surfaces are joined by contact with at least one of said rollers being fixed and the opposing rotating one motorized and movable from a contact and grasping position for the lower edge of each banknote to a separated one for dropping the banknotes between them.

18. Safe in accordance with claim 1 wherein said first path has immediately downstream of said third withdrawal and routing station a section for control of the positioning of the banknotes confluent in a bifurcation with alternative directions towards a return branch towards a scrap banknote recovery means or towards said second sorting path.

19. Safe in accordance with claim 18 wherein said recovery means consist of a purposeful tank arranged contiguous with said banknote acceptance device.

20. Safe in accordance with claim 1 wherein said containment storage unit is divided in modular tanks which are fixed and located in sequence along said second path with the respective inlet sides controlled by switch devices.

21. Safe in accordance with claim 20 wherein each modular tank consists of a boxed body in the upper mouth of which is mounted a drum selector rotating by successive steps along a horizontal axis having radial notches for banknote insertion and counting, a selector which stands above a lower table for stacked collection of the banknotes scrapped by said selector and located inclined for release of banknotes, controlled by associated withdrawal means, on an underlying third path for sending back to said restitution door.

22. Safe in accordance with claim 21 wherein said withdrawal means consist of a series of roller pairs located mutually facing in cascade with at least the first of which having continuous movement for a predetermined number of banknotes to be extracted and for stopping of the completed moving after extraction.

23. Safe in accordance with claim 21 wherein said third path has downstream of said tanks a series of switch devices for alternating transit of the banknotes to or from said cartridge means or towards said door directly opening toward the exterior.

24. Safe in accordance with claim 1 comprising a removable cartridge means for accumulation of banknotes, consisting of at least one pair of boxed banknote storage containers having respective controlled slots for passage of the banknotes and internal means for vertical movement thereof with there also being provided conventional means of engagement with said armored boxed frame for location on one side thereof and separated from said storage container by an associated bulkhead with there being interposed sections for connection of said grasping and conveyance means between said cartridge means and said second and third path.

25. Safe in accordance with claim 24 wherein of said boxed storage containers a first upper one for emptying is assigned to accumulation of banknotes extracted from said tanks and/or from said acceptance device and a lower one for resupply is assigned to supplying banknotes to said storage containers.

26. Safe in accordance with claim 1 comprising a means of control for the correct banknote positioning in several models with a first one being located in said control section downstream of said third station and a second one in the rising terminal section of said third path immediately downstream of the lower boxed container.

27. Safe in accordance with claim 26 wherein said inspection means are designed for sensing overlapping between banknotes with only the overlapped banknotes being eliminated from the accounting operation and sent to said recovery tank with said accounting operation being divided in performance for only the time necessary for replacement of the eliminated banknotes.

* * * * *